US005664854A

United States Patent [19]

Letch

[11] Patent Number: 5,664,854

[45] Date of Patent: Sep. 9, 1997

[54] COLLAPSIBLE SHOWCASE FOR RETAIL/ TRADE SHOW USE

[76] Inventor: Ronald C. Letch, 14 Atkinson St., Newburyport, Mass. 01950

[21] Appl. No.: 620,934

[22] Filed: Mar. 22, 1996

[51] Int. Cl.[6] ..... A47B 43/00

[52] U.S. Cl. ..... 312/262; 312/258; 312/135; 312/114

[58] Field of Search ..... 312/258, 262, 312/114, 128, 136, 132, 133, 290, 126, 135

[56] References Cited

U.S. PATENT DOCUMENTS

| | | | |
|---|---|---|---|
| 168,879 | 10/1875 | Colbert | 312/258 |
| 771,731 | 10/1904 | Johnson | 312/258 X |
| 846,121 | 3/1907 | Matthews, Jr. | 312/136 |
| 963,769 | 7/1910 | Johnson et al. | 312/262 X |
| 1,128,031 | 2/1915 | Needleman | 312/258 |
| 1,986,077 | 1/1935 | Spang | 312/258 X |
| 3,294,464 | 12/1966 | Lew | 312/258 |
| 3,434,769 | 3/1969 | Salet | 312/258 |
| 3,644,011 | 2/1972 | MacDonald | 312/258 |
| 4,572,593 | 2/1986 | Takamizawa | 312/114 |
| 4,579,401 | 4/1986 | Mears | 312/258 |
| 4,703,981 | 11/1987 | Stewart | 312/258 |
| 4,974,526 | 12/1990 | Wiygul | 108/159 |
| 5,259,669 | 11/1993 | Leach et al. | 312/258 |

FOREIGN PATENT DOCUMENTS

| | | | |
|---|---|---|---|
| 2497644 | 7/1982 | France | 312/258 |
| 10237 | 8/1887 | United Kingdom | 312/262 |

*Primary Examiner*—Peter M. Cuomo
*Assistant Examiner*—Janet M. Wilkens

[57] ABSTRACT

A collapsible showcase has a rear panel, top panel, front panel, floor panel and two pairs of side panels. These panels are hinged in such a manner as to allow the top panel to fold back and hang parallel to the rear panel, the floor panel to fold up parallel to the front panel, the pairs of side panels to fold inward, drawing the front panel and rear panel together to achieve a collapsed configuration. A means for support for at least one shelf is attached inside the showcase and is rotated 90° out of the way in the collapsed configuration. An access to the interior is provided through the rear of the showcase. The top panel can be secured in position in the assembled configuration.

6 Claims, 6 Drawing Sheets

COLLAPSIBLE SHOWCASE FOR RETAIL/ TRADE SHOW USE

BACKGROUND—FIELD OF INVENTION

This invention relates to showcases, specifically to a form of collapsible showcase to be used principally in the retail and trade show environment.

BACKGROUND—DESCRIPTION AND DISCUSSION OF PRIOR ART

Typically, showcases used in the retail area or at trade shows have the requirement that the area in the case extend from floor to approximately waist high. A further requirement is that these showcases be totally enclosed for security purposes, but have a provision for access to the interior from the rear or proprietary side. The access means must operate in a minimum space due to the usually restricted floor space available where the cases are used. These showcases must be strong and rigid to withstand forces imposed by such things as customers leaning on them or cash registers and other items being placed on them. Accommodation for supporting one or more optional shelves is another typical requirement. The subject showcases usually require the finished appearance and quality look of fine furniture.

In order to meet the above criteria, it is typical to manufacture, ship and store these showcases as completely assembled, free standing units. This has resulted in relatively expensive shipping and handling costs. In the trade show business, shipping of the showcases is a frequent occurrence. In the retail area, it is sometimes necessary to warehouse or relocate showcases during seasonal changeovers or store reconfigurations.

Consequently, a need exists for a collapsible showcase design which exhibits the features and quality appearance of the traditional showcase as described above, in the assembled mode. In the collapsed form, the showcase should be compact, lightweight and totally self-storing with no loose parts or tools needed for assembly or disassembly. Another desired feature is that no special skills or technical capability should be required to accomplish assembly or disassembly.

Attempts have been made to meet the aforementioned needs by transporting and storing the units fully or partially disassembled. This results in the added time and cost of on site assembly, usually requiring special tools and keeping track of many loose parts. The latter is a special inconvenience at trade shows where time for set up or breakdown is at a minimum.

Other attempts have been made at providing collapsible showcases to overcome the above mentioned problems, but these approaches have failed to fully meet the traditional requirements for retail and/or trade show use as previously delineated.

U.S. Pat. No. 5,259,669—Leach, et al., Nov. 9, 1993 discloses a light weight collapsible trade show display case. The support legs are opposing rectangular side panels which are hinged to the base of the showcase. This design precludes use of the display case in a floor to waist high mode. Also, no provision for support of optional shelves exists. Further, one of the major components, the front fascia panel, becomes a loose piece in the disassembled mode.

U.S. Pat. No. 3,434,769—T. E. Salet, Mar. 25, 1969 describes a collapsible display case in which the opposite vertical sides are foldable about hinges toward one another and over the bottom or base. The top is folded down over the sides and in engagement with dowels to provide a solid enclosed unit. This design restricts itself to small tabletop use only, thus not lending itself to full floor to waist display. Opening the top for access would not be acceptable in most retail/trade show situations.

U.S. Pat. No. 4,579,401—Mears, Apr. 1, 1986 describes a collapsible cabinet which in the assembled configuration provides a strong, rigid cabinet, but is not totally enclosed and as such, provides no ;security in the retail/trade show environment. Further, there is no practical way to utilize this concept as a totally enclosed display case.

U.S. Pat. No. 4,572,593—Takamizawa, et al, Feb. 25, 1986 describes a showcase design which is semi-collapsible and semi-knockdown with many loose parts, which is time consuming and requires a person with skill and hand tools to assemble. This would be unacceptable to the trade show retailer.

The present invention improves on all the above art by meeting the specific criteria of the retail/trade show environment as delineated at the outset of this section.

OBJECTS AND ADVANTAGES

Accordingly, it is the primary objective of the present invention to provide a lightweight, strong, collapsible showcase which can be quickly assembled to meet the traditional requirements of the retail and trade show area. Further objects and advantages are:

(a) To provide a collapsible showcase which will be strong and rigid in the assembled configuration;

(b) To provide a collapsible showcase which can be assembled in a very short time without the need for tools;

(c) To provide a collapsible showcase which is totally enclosed in its assembled configuration, thus providing security for the display;

(d) To provide a collapsible showcase which has a means for access from the proprietary or rear side, such access requiring no extra clearance or floor space to operate.

(e) To provide a collapsible showcase which in its collapsed form has no loose parts;

(f) To provide a collapsible showcase which has an integral adjustable means of support for optional shelves;

(g) To provide a collapsible showcase which can be folded into a compact, flat lightweight, self-contained configuration for easy and relatively inexpensive shipping and storage; and, (h) To provide a collapsible showcase which requires no special skill to assemble or disassemble.

Figure 1:
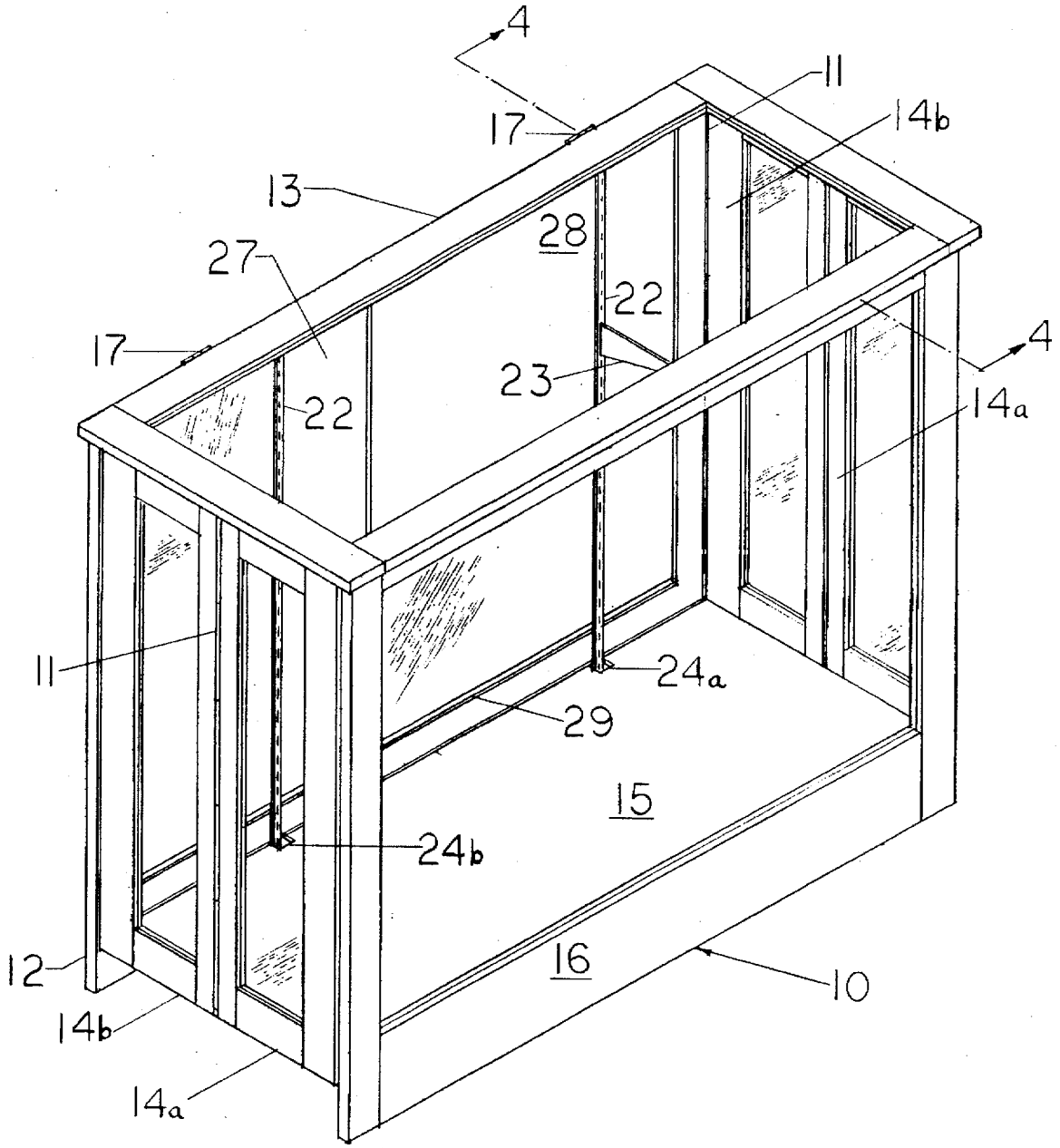
FIG. 1 is an isometric view of the invention shown in assembled configuration.

| List of Reference Numerals | |
|---|---|
| 10 - Collapsible Showcase | 20a - Pillow Block |
| 11 - Hinge | 20b - Pillow Block |
| 12 - Rear Panel | 21 - Blind Hole |
| 13 - Top Panel | 22 - Shelf Standards |
| 14a - Side Panel | 23 - Brackets |
| 14b - Side Panel | 24a - Cutout |
| 15 - Floor Panel | 24b - Cutout |
| 16 - Front Panel | 25 - Bolt Latch |
| 17 - Hinge | 26 - Blind Hole |
| 18 - Hinge | 27 - Sliding Door Panel |
| 19 - Stop | 28 - Sliding Door Panel |
| | 29 - Sliding Door Track |

SUMMARY

Accordingly, the aforementioned objects and advantages are met by the present invention by providing a showcase which is collapsible from an assembled configuration to a collapsed configuration. The invention includes a rear panel to which are hinged two pairs of foldable side panels. The two pairs of foldable side panels are also hinged to a front panel. A top panel is hinged to the rear panel and can be folded back through at least 270° of rotation. A floor panel is hinged to the front panel and can be folded up through at least 90° of rotation. A means for supporting at least one shelf is attached to the rear panel and can be rotated through at least 90° of rotation. In the collapsed configuration, the top panel is folded back and hangs parallel to the back side of the rear panel. The floor panel is folded up and lies parallel to the inside surface of the front panel. The pairs of side panels have been folded inward so that they lie parallel to each other and have drawn the front and rear panel inward to each other. A means of access to the showcase is provided in the rear panel, and a means to secure the top panel when in the assembled configuration is also provided. The resulting collapsible showcase of the present invention has no loose parts and can be transformed from collapsed configuration to assembled configuration or vice versa in less than one minute with no tools or special skills required. Further, the collapsible showcase (of the present invention) is totally enclosed in the assembled configuration, has a means to secure the top, a means for access from the rear, provides a means of support for at least one shelf and provides floor to waist high show capability, thereby meeting the needs of the retail/trade show market.

Description of the Preferred Embodiment—FIGS. 1 to 6

Figure 3:
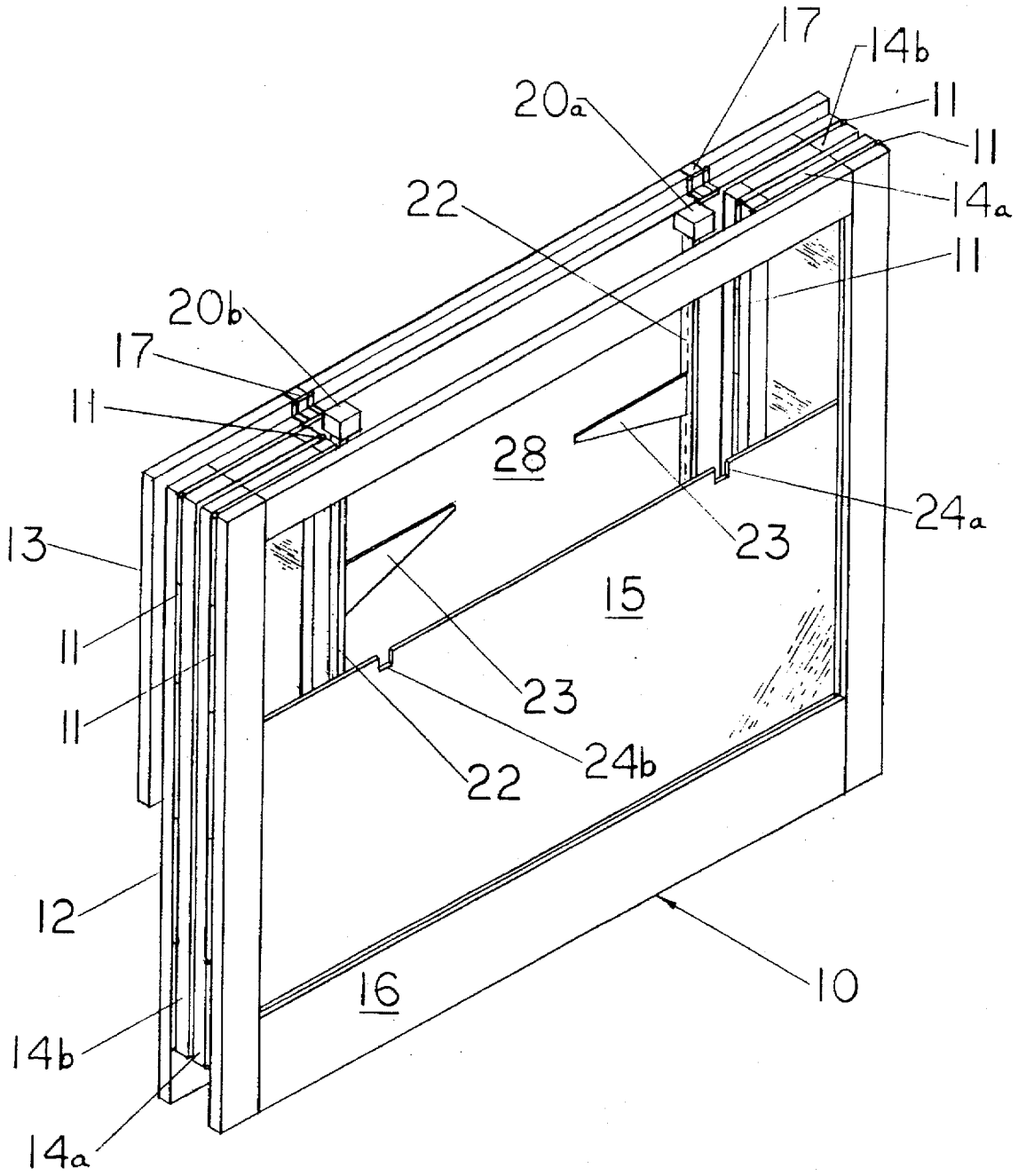
FIG. 3 is an isometric view of the invention shown in collapsed configuration.

Refer now to FIG. 1 which is an overall drawing of the preferred embodiment. The invention comprises generally a collapsible showcase 10. Showcase 10 includes a rear panel 12, a top panel 13, two pairs of side panels 14*a*, 14*b*, a floor panel 15, and a front panel 16. Showcase 10 has two configurations, i.e., assembled configuration (FIG. 1) and the collapsed configuration (FIG. 3).

Figure 2:
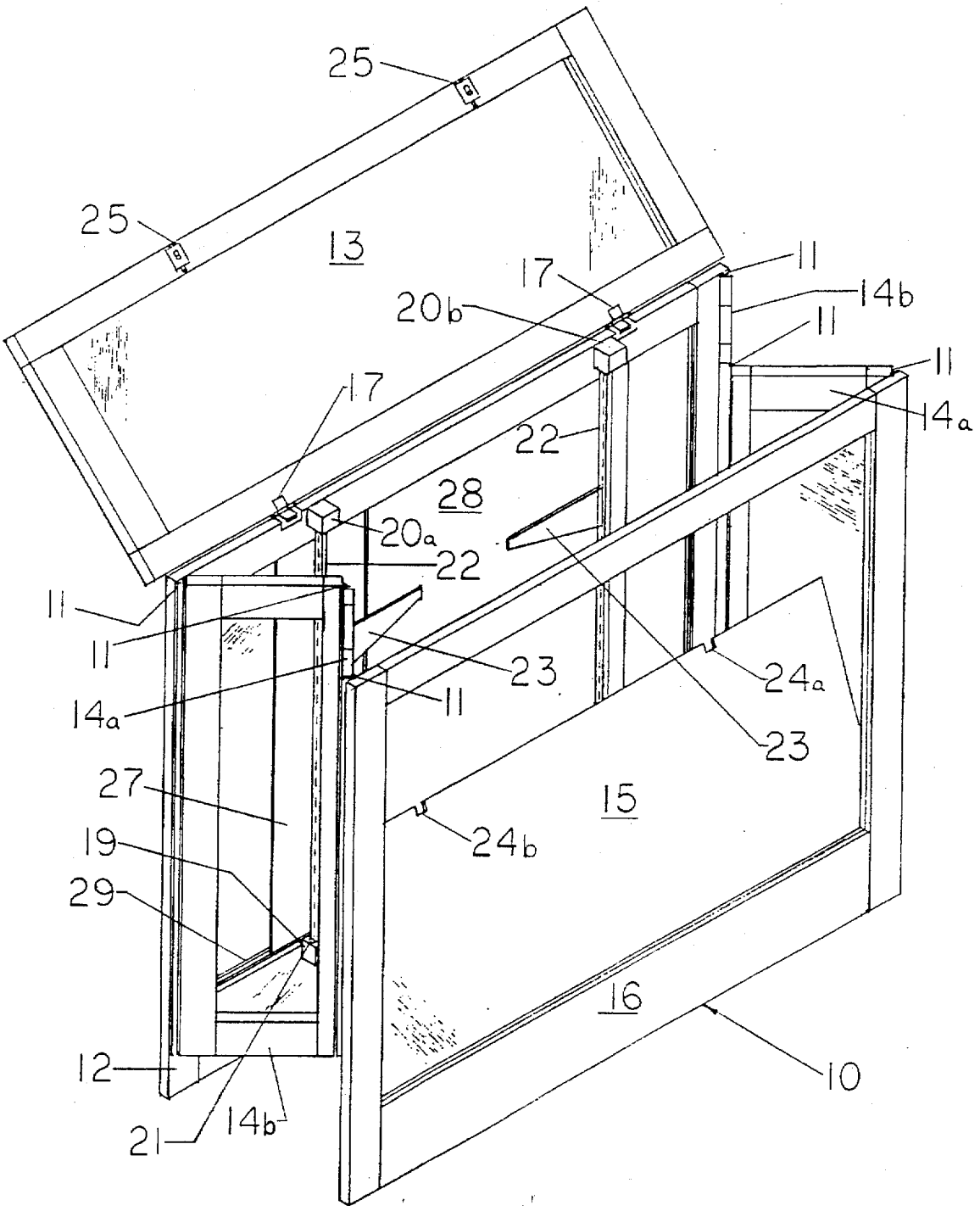
FIG. 2 is an isometric view of the invention shown in semi-collapsed configuration.

Top panel 13 is connected by a hinge means 17 to rear panel 12, allowing at least 270° of rotation of top panel 13 with respect to rear panel 12, as shown in FIG. 2.

Side panels 14*a*, 14*b* are connected by a hinge means 11, respectively to each other, to rear panel 12 and to front panel 16 as is best illustrated in FIG. 2.

Hinges 11 allow pairs of side panels 14*a*, 14*b* to fold inwardly as shown in FIG. 2, so that rear panel 12 and front panel 16 move towards each other. Hinges 11 restrict movement of side panel 14*a*, 14*b* to 180° of motion relative to each other, thus preventing side panels 14*a*, 14*b* from folding outward beyond the in-line position illustrated in FIG. 1.

Figure 4:
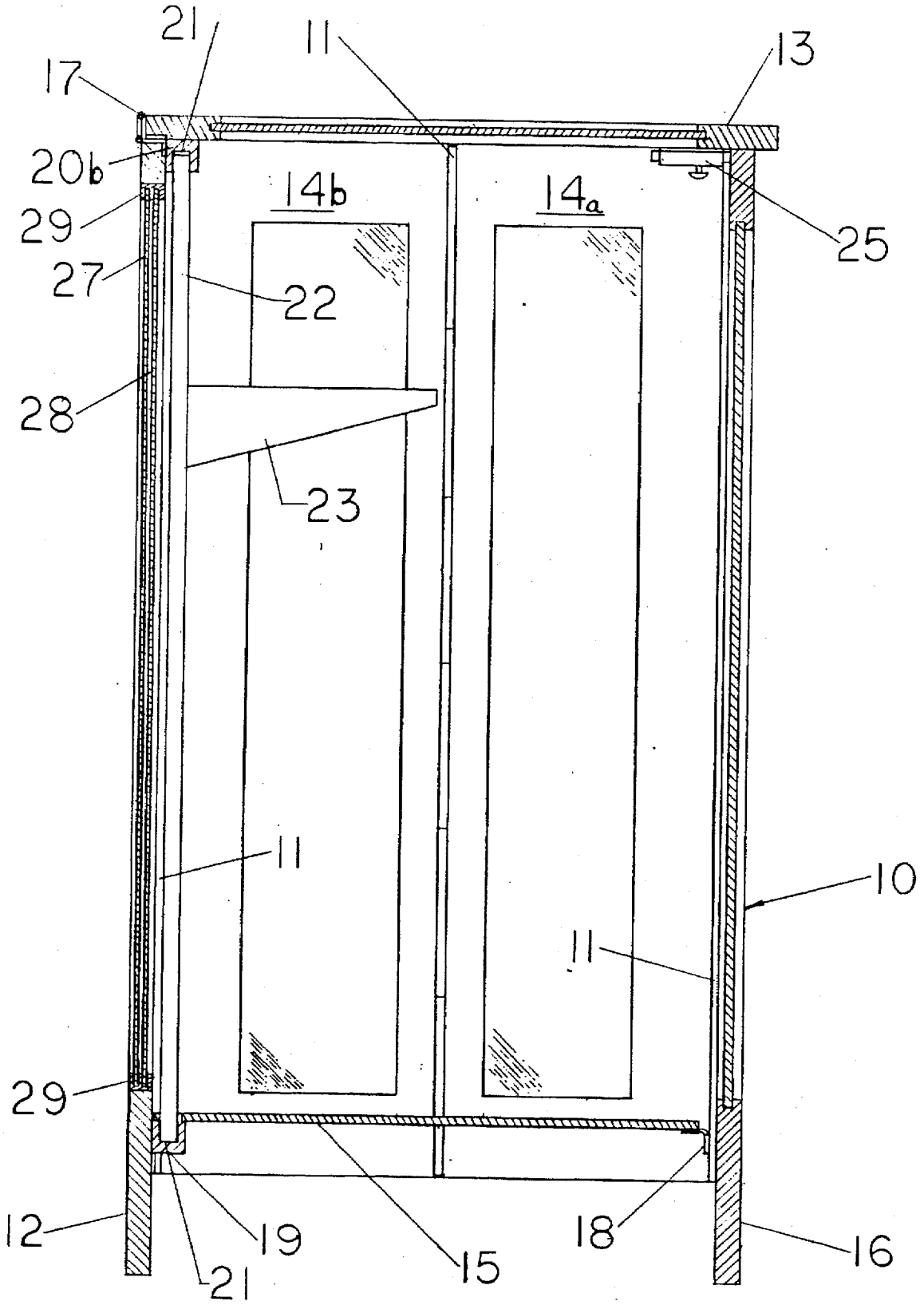
FIG. 4 is a section, as shown by Lines 4—4 in FIG. 1 of a side view of the invention in assembled configuration.

As shown in FIG. 4, floor panel 15 is connected by a hinge means 18 to front panel 16and allows at least 90° rotation of floor panel 15 with respect to front panel 16. As shown in FIG. 1, when showcase 10 is in the assembled configuration, floor panel 15 lies in a horizontal position 90° from the inner surface of front panel 16, thus forming a floor of showcase 10. When showcase 10 is in the collapsed configuration, floor panel 15 lies in a vertical position parallel to front panel 16, as shown in FIG. 3, and is enclosed in a space between side panels 14*a* and front panel 16.

Figure 5:
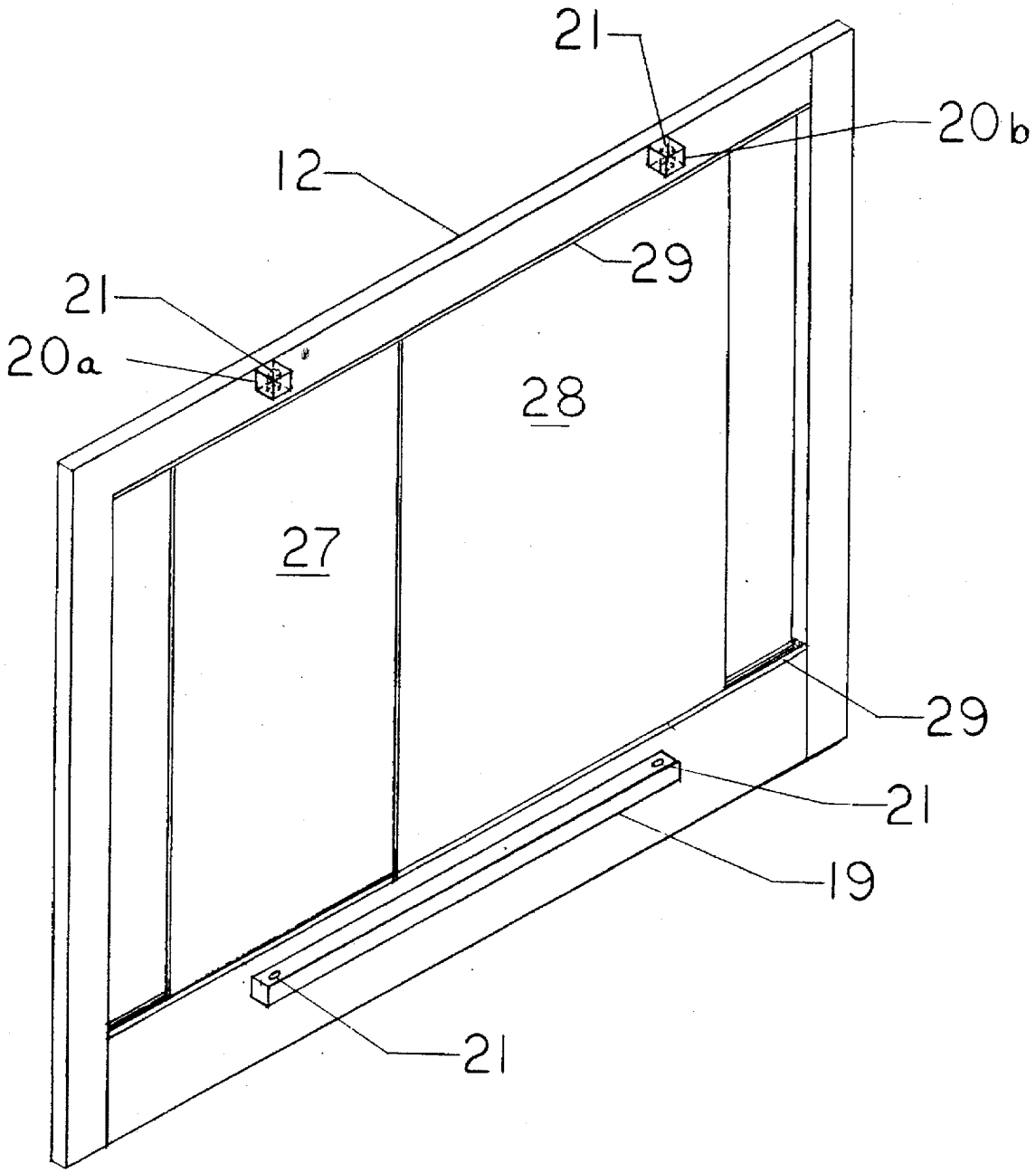
FIG. 5 is an isometric view of the rear panel shown in isolation.
Figure 6:
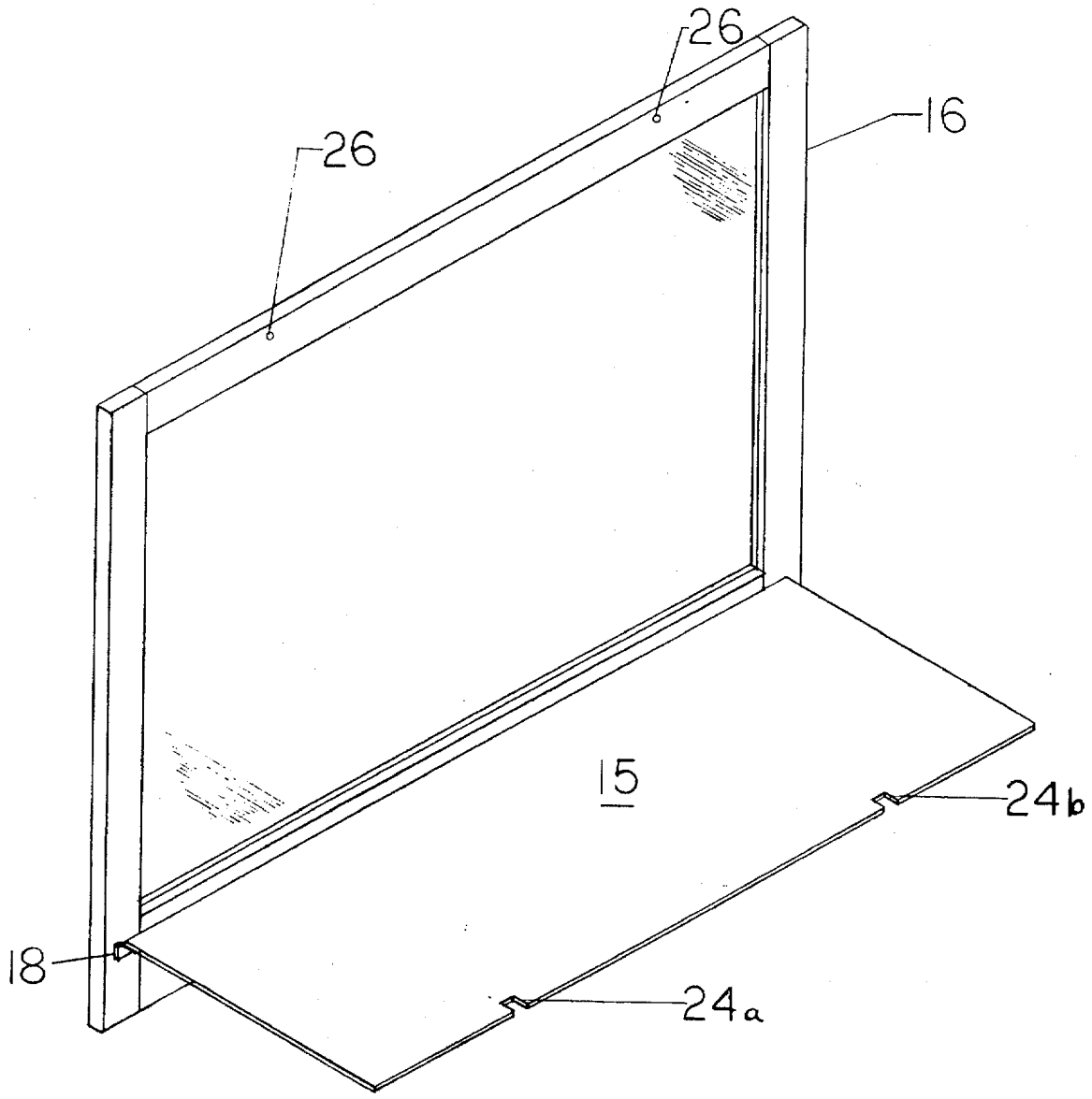
FIG. 6 is an isometric view of the front panel shown in isolation.

Rear panel 12 has a stop 19, best shown in FIG. 5, attached to the lower inside surface of rear panel 12. Stop 19 provides a means of support for floor panel 15 when in the horizontal position, as shown in FIG. 4.

When showcase 10 is in the assembled configuration and floor panel 15 is in the horizontal position, there exists a predetermined tight fit between floor panel 15 and both pairs of side panels 14*a*, 14*b* preventing the inward movement of both pairs of panels 14*a*, 14*b*.

One embodiment of a device to provide support for optional shelves inside showcase 10 comprises a pair of pillow blocks 20*a*, 20*b* attached to the inside upper surface of the rear panel 12, as shown in FIG. 2. A blind hole 21 exists in pillow blocks 20*a*, 20*b*. Two blind holes 21 exist in floor stop 19. Pillow blocks 20*a*, 20*b* and floor stop 19 are attached to rear panel 12 so that blind holes 21 are in vertical alignment, as shown in FIG. 5. The open end of blind holes 21 in floor stop 19 face upward. The open end of blind holes 21 in pillow blocks 20*a*, 20*b* face downward, as is best shown in FIG. 4 and FIG. 5. FIG. 2 and FIG. 4 show shelf standards 22 with brackets 23 attached. Shelf standards 22 are encapsulated between pillow blocks 20*a*, 20*b*, respectively, and shelf stop 19, as is best shown in FIG. 4. Shelf standards 22 with brackets 23 attached are supported in a vertical position by the inner surfaces of blind holes 21, but are allowed to swivel in them. When shelf standards 22 and shelf bracket 23 are swiveled to a position perpendicular to rear panel 12, they provide a means for support for an optional shelf not shown.

A pair of cutouts 24*a*, 24*b* are placed in floor panel 15 to allow clearance past standards 22 when floor panel 15 is in the horizontal position, as is best shown in FIG. 1.

The foregoing description defines a shelf support means which can be pivoted at least 90° from a position perpendicular to rear panel 12 to a position parallel to rear panel 12, as shown in FIG. 2.

Sliding door tracks 29 are attached to the upper and lower inner surfaces, respectively, of rear panel 12, as shown in FIG. 4. Sliding door panel 27 and a sliding door panel 28 are encapsulated in sliding door tracks 29, as best shown in FIG. 4 and FIG. 5. These sliding door panels 27, 28 represent a preferred embodiment for providing a means of access to the interior of showcase 10 in the assembled configuration.

A preferred embodiment of providing a means of securing top panel 13 to some part of the interior of showcase 10 comprises a pair of sliding bolt latches 25 mounted on the inside surface of top panel 16, as shown in FIG. 2. A pair of blind holes 26 are located in front panel 16 so as to align with and accept the bolts of sliding bolt latches 25 when top panel 13 is in the closed position of the assembled configuration of showcase 10, as can best be seen in FIG. 4 and FIG. 6. This provides added stability to showcase 10 in the assembled configuration and security from unwanted opening of top panel 13 during use.

In the preferred embodiment of the invention, as depicted in FIG. 1–FIG. 6 in the foregoing description of showcase 10, panels 12, 13, 14*a*, 14*b*, 16 are of wood frame construction encapsulating glass inserts. However, inserts can be transparent material, opaque material or some combination thereof. Further, it is obvious that these panels can be made from any satisfactory, strong and rigid material and could be solid panel construction. Floor panel 15 and door panels 27, 28 can be made of any suitably stiff material. Hinges 11, 17, 18 are commercially available and can vary in design but still must meet the specific requirements of range of motion as disclosed in the invention. Any appropriate latching means can be substituted for bolt latches 25.

Therefore, the foregoing description of the preferred embodiment of the invention has been presented for the purposes of illustration and description. It is not intended to be exhaustive or to limit the inventor to the precise form disclosed. Many modifications and variations are possible in light of the above teaching. It is intended that the scope of the invention be limited not by this detailed description but, rather, by the claims appended hereto.

Operation—FIGS. 1 to 6

The simple and rapid manner of transforming the showcase 10 from the assembled configuration FIG. 1 to the collapsed configuration. FIG. 3 is as follows:

(a) Slide door panels 27, 28 open so as to allow access to the inside of showcase 10.

(b) Disengage slide bolt latches 25 from front panel 16.

(c) Lift top panel 13 through 270° of motion until it hangs vertically parallel to the back surface of rear panel 12.

(d) If necessary, remove any optional shelves.

(e) Swivel shelf standards 22 so that shelf brackets 23 lie in a position against and parallel to door panels 27, 28.

(f) Raise floor panel 15 90° so that it is in a position parallel to front a panel 16.

(g) Initiate the inward folding motion of pairs of panels 14*a*, 14*b* by pressing inward at the center points where pairs of panels 14*a*, 14*b* are joined by hinges 11.

(h) Complete the collapsing action by drawing front panel 16 and rear panel 12 together.

Transforming the showcase 10 from the collapsed configuration (FIG. 3) to the assembled configuration (FIG. 1) is a simple matter of accomplishing the foregoing steps, (a)–(h), in reverse order, (h)–(a), except that in step (g), outward folding action of pairs of panels 14*a*, 14*b* must be initiated by pressing outward at center points.

Having thus described the invention, what I claim is:

1. A collapsible showcase comprising:

(a) a rear panel, a top panel, two pairs of side panels, a floor panel, a front panel;

(b) said top panel connected by hinge means to said rear panel, allowing at least 270° rotation of said top panel with respect to said rear panel;

(c) said floor panel comprising a hinge means connecting said floor panel to said front panel, allowing at least 90° rotation of said floor panel with respect to said front panel;

(d) said pairs of side panels comprising a hinge means to connect said pairs of side panels to each other respectively and connecting said side panels to said rear panel and to said front panel allowing said side panels to fold inward so that said rear panel and said front panel move toward each other;

(e) said rear panel comprising a means to provide access to the interior of said collapsible showcase; and, (f) said rear panel further comprising a device for supporting optional shelves inside said collapsible showcase.

2. The collapsible showcase of claim 1 wherein said floor panel has a predetermined tight fit between said floor panel and said pairs of side panels.

3. The collapsible showcase of claim 1 whereby said device for supporting an optional shelf can be pivoted at least 90° from a position perpendicular to said rear panel to a position essentially parallel to said rear panel.

4. The collapsible showcase of claim 1 whereby said hinge means connecting said pairs of side panels restrict motion of said side panels to 180° rotation with respect to each other.

5. The collapsible showcase of claim 1 whereby said top panel comprises a means of securing said top panel to some part of the interior of said collapsible showcase.

6. The collapsible showcase of claim 1 whereby said rear panel further comprises a means of support for said floor panel when said floor panel is in the horizontal position.

* * * * *